US010475255B2

(12) United States Patent
Peeters et al.

(10) Patent No.: US 10,475,255 B2
(45) Date of Patent: Nov. 12, 2019

(54) ROAD TOLL SYSTEM LINKING ON BOARD UNIT WITH VEHICLE

(71) Applicant: Telit Automotive Solutions NV, Leuven (BE)

(72) Inventors: Michael M. P. Peeters, Tourinnes-la-Grosse (BE); Jan L. R. M. Taelman, Braine-le-Chateau (BE); Frank C. H. Daems, Rotselaar (BE); Veroni Ballet, Lubbeek (BE)

(73) Assignee: Telit Automotive Solutions NV, Leuven (BE)

( * ) Notice: Subject to any disclaimer, the term of this patent is extended or adjusted under 35 U.S.C. 154(b) by 125 days.

(21) Appl. No.: 15/185,385

(22) Filed: Jun. 17, 2016

(65) Prior Publication Data

US 2016/0292930 A1 Oct. 6, 2016

Related U.S. Application Data

(63) Continuation of application No. 12/597,146, filed as application No. PCT/IB2008/051657 on Apr. 29, 2008, now Pat. No. 9,401,052.

(30) Foreign Application Priority Data

May 4, 2007 (GB) ..... 0708720.8

(51) Int. Cl.

| | |
|---|---|
| ***G07B 15/06*** | (2011.01) |
| ***G07B 15/02*** | (2011.01) |
| ***G08G 1/017*** | (2006.01) |

(52) U.S. Cl.
CPC ..... *G07B 15/063* (2013.01); *G07B 15/02* (2013.01); *G08G 1/017* (2013.01)

(58) Field of Classification Search
None
See application file for complete search history.

(56) References Cited

U.S. PATENT DOCUMENTS 5,303,163 A * 4/1994 Ebaugh ..... G07C 5/085 340/439
5,471,393 A * 11/1995 Bolger ..... G01C 21/30 701/446
5,974,356 A * 10/1999 Doyle ..... G01C 21/28 342/357.3
6,037,942 A * 3/2000 Millington ..... G01C 21/3611 345/156

(Continued)

*Primary Examiner* — Brian A Zimmerman
*Assistant Examiner* — Renee Dorsey
(74) *Attorney, Agent, or Firm* — Pearl Cohen Zedek Latzer Baratz LLP

(57) ABSTRACT

A road toll system comprises a vehicle-mounted unit comprising a satellite navigation system implementing a position tracking function; transmitting means for transmitting position or route information to a remote server; and a unique identification device for attaching to the vehicle, and associated with the satellite navigation receiver. The road toll system function is enabled only when the identification device is present. The identification device comprises an electronic device which is adapted to alter by detachment or attempted detachment such as to prevent the road toll system function being enabled. This system increases the security of this type of system and makes fraudulent use of the system increasingly difficult.

19 Claims, 1 Drawing Sheet

(56) References Cited

U.S. PATENT DOCUMENTS

| | | | | |
|---|---|---|---|---|
| 6,225,890 | B1 * | 5/2001 | Murphy | B60R 25/012 307/10.5 |
| 6,718,263 | B1 * | 4/2004 | Glass | G07B 15/02 455/428 |
| 8,086,523 | B1 * | 12/2011 | Palmer | G06Q 40/025 705/38 |
| 8,090,598 | B2 * | 1/2012 | Bauer | G06Q 40/02 705/4 |
| 2003/0088348 | A1 * | 5/2003 | Gustavsson | G01C 22/02 701/29.1 |
| 2003/0195676 | A1 * | 10/2003 | Kelly | G07C 5/008 701/31.4 |
| 2004/0104842 | A1 * | 6/2004 | Drury | G01C 21/34 342/357.31 |
| 2004/0158430 | A1 * | 8/2004 | Ballard, Jr. | B60K 28/063 702/183 |
| 2005/0021197 | A1 * | 1/2005 | Zimmerman | G06Q 10/10 701/31.4 |
| 2005/0168352 | A1 * | 8/2005 | Tomer | G07B 15/02 340/932.2 |
| 2007/0150139 | A1 * | 6/2007 | Hardy | G01C 22/02 701/521 |
| 2007/0273534 | A1 * | 11/2007 | McGinn | G06Q 10/00 340/572.8 |
| 2008/0294312 | A1 * | 11/2008 | O'Connor | G07C 5/085 701/32.5 |

* cited by examiner

ROAD TOLL SYSTEM LINKING ON BOARD UNIT WITH VEHICLE

CROSS-REFERENCE TO RELATED APPLICATIONS

This application is a continuation application of U.S. patent application Ser. No. 12/597,146, filed Oct. 22, 2009, which is a National Phase Application of PCT International Application No. PCT/IB2008/051657, International Filing Date Apr. 29, 2008, which in turn claims priority from UK Patent Application No. 0708720.8, filed May 4, 2007, all of which are incorporated herein by reference in their entirety.

This invention relates to road toll systems, especially public road toiling systems and after-market on board units (OBUs) for implementing an automatic system for deducting road tolls based on the road sections used. In particular, the invention relates to a road toll system in which an on-board unit is linked with the related car or related user of the system.

The integrated use of telecommunications and informatics is known as telematics. Vehicle telematics systems may be used for a number of purposes, including collecting road tolls, enhanced navigation based services, managing road usage (intelligent transportation systems), tracking fleet vehicle locations, recovering stolen vehicles, providing automatic collision notification, location-driven driver information services and in-vehicle early warning notification alert systems (car accident prevention).

Road tolling is considered as one of the first likely large volume markets for vehicle telematics. Telematics is now beginning to enter the consumer car environment as a multimedia service box for closed services. These markets are still limited in volume and are considered as fragmented markets. The European Union and with The Netherlands as a leading country has the intention to introduce road tolling as an obligatory function for every car from 2012 onwards.

So far, road tolling has been used for highway billing, truck billing and billing for driving a car in a certain area (e.g. London city). Toll plazas at which vehicles must stop are generally used, or else short range communications systems allow automatic debiting of a fund when a vehicle passes.

The road tolling functions needed in the near future will impose the requirement for less (or no) infrastructure and will impose tolling for every mile driven.

It is envisaged that each vehicle will have a GNSS (GPS) system on board and a network connection, such as a mobile telephone network (GSM), to enable information to be relayed to a centralized road tolling system.

The charging system in an automated road toll system can be based on distance traveled, the time, location and vehicle characteristics. The road tolling may apply to all vehicles or it may exclude certain classes of vehicle (for example with foreign number plates).

An issue with this type of system is that there is a need to increase the security of this type of system and to make fraudulent use of the system as difficult as possible.

According to a first aspect of the invention, there is provided a road toll system comprising a vehicle-mounted unit comprising:

a satellite navigation system implementing a position tracking function;

transmitting means for transmitting information to a remote server; and a unique identification device for attaching to the vehicle such that it is permanently fixed in a stationary position relative to the vehicle, and associated with the satellite navigation system, wherein the road toll system function is enabled only when the identification device is present, wherein the identification device comprises an electronic device which is adapted to alter by detachment or attempted detachment such as to prevent the road toll system function being enabled.

This aspect of the invention provides a firm link between the system and a specific vehicle by providing a unique identification device for the vehicle, which cannot be removed once attached. This enables the satellite navigation system to be an after-market device, and unauthorised moving of the satellite navigation system between vehicles cannot be effected. The binding of the system to one (or more) vehicle can be effected by the unique identification device, so that the remainder of the system does not need to be complicated for this purpose.

The system can include an interrogation system for interrogating the identification device. This can use a wireless interrogation signal. The identification device can be a passive device.

In a modification, the same OBU can be registered for multiple cars, by providing multiple tags. Alternatively, the OBU can have a way to verify the authenticity of the identification device (for instance if the tag has a private key and a public key signed by a recognized certification authority), enabling the use of the same OBU for an unlimited number of tags. This approach would simplify the OBU distribution chain, since the tag and OBU do not need to be paired before distribution, and also simplifies authorised replacement of the tag.

This enables a single OBU to be used in different vehicles of the same user. Multiple identifications can then be registered by the OBU. Each vehicle can still have a unique tag. The system then is operable if one of the registered valid tags is detected.

The identification device can comprise an RFID sticker which is interrogated by the satellite navigation system in use. The sticker can be arranged so that if it is removed after application, an antenna or other functionality is disabled, rendering the RFID device malfunctioning.

The system may further comprise means for determining the routes taken by the vehicle based on the position tracking information. Thus, routes can be calculated on-board. Instead, the system can simply transmit position information.

According to a second aspect of the invention, there is provided a road toll system comprising a vehicle-mounted unit and a remote server, comprising:

a satellite navigation system implementing a position tracking function; and transmitting means for transmitting position or route information to the remote server, wherein the system is adapted to receive an odometer value for the vehicle when the system is installed or at a reset time, and wherein the system is adapted to compute a distance traveled based on the transmitted position or route information, thereby to enable comparison of a new odometer value with an expected odometer value.

This aspect of the invention provides an additional security measure by enabling the vehicle odometer value to be checked with the expected value based on the satellite system. This aspect may be combined with the first aspect to provide multiple levels of anti-tampering security.

The transmitting means is preferably adapted to transmit an odometer value for the vehicle when the system is installed or at a reset time. This provides an (automated) installation function. Alternatively, the server (or OBU) can be adapted to receive an odometer value for the vehicle when the system is installed or at a reset time from the user of the vehicle during a registration process. This provides a user-initiated installation process, for example using a website of the system administrator.

The registration process can comprise the user providing (to the on board unit or the remote server):

a user identification;

a vehicle license number;

a system ID; and a vehicle odometer value.

Examples of the invention will now be described with reference to the accompanying drawings, in which.

The invention provides a road toll system in the form of a vehicle-mounted unit having a satellite navigation receiver implementing a position tracking function. The system can determine either simple position information, so that the routes are calculated by a server, or else the system can calculate the routes taken by the vehicle based on the position tracking information. The invention provides improved security by providing an association between the vehicle and the system.

Figure 1:
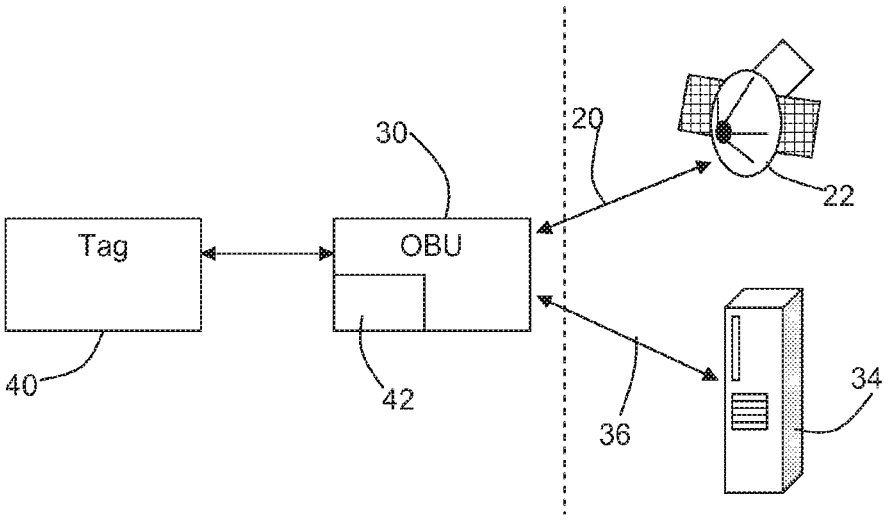
FIG. 1 shows an example of system of the invention.

FIG. 1 shows a first implementation of the invention, based on an off-line minimal client system for infrastructure-less (i.e. without roadside beacons) road tolling.

GPS (or more generally GNSS) data 20 from a number of satellites 22 is captured by a GNSS (GPS) receiver forming part of an on board unit 30. This data is decoded to position data (longitude-latitude). The position data together with timing (clock) data is stored in a memory, which may be in the form of a Smart card (Smart XA) so that the information in memory can easily be interrogated, and provides a tamper resistant environment. Periodically, a batch of stored data is sent to the back-end road tolling server 34, as shown by the mobile connection 36. This can be ideally done by a GSM function (General Packet Radio Service "GPRS" or Third Generation mobile telephony "3G") using a cellular modem. The back-end server 34 is able to reconstruct out of this data the journeys that are driven.

The server 34 also contains a database of road prices which were valid at a certain time. Finally the total price is computed and the driver gets an invoice (e.g. monthly).

In order to assure that data is not tampered by the user, data is exchanged in cryptographic way (e.g. DES or 3DES) between the GPS decoder and the memory.

Each journey is very small compared to the total monthly journeys attracting billing, and this means a continuous on-line transaction scheme may not be desirable, hence the desire for a batch download.

In accordance with a first aspect of the invention, the vehicle in which the system is installed is provided with a unique identification device 40 for attaching to the vehicle. The device 40 is associated with the on board unit 30, and the road toll application hosted by the unit 30 is enabled only when the identification device is present.

For this purpose, the on board unit has a sensor 42 for detecting the presence, authenticity and identity of the device 40. The device 40 and sensor 42 are designed according to state-of-the art techniques to prevent unauthorised cloning of the device 40, for example by using anti-counterfeiting RFID technology.

The communication link between the on board unit 30 and the tag 40 is a very short distance communications link. The RFID tag is destroyed when there is attempted removal of the tag from the vehicle.

If the RFID tag is not present, the on board unit will not function. Clearly, there needs to be a way to detect this is happening as part of the enforcement procedure. Spot checks of a vehicle can be used to determine if the on board unit has recorded the current journey. As will be described in further detail below, one approach which enables permanent usage of the system to be verified is to compare a total distance traveled by the vehicle as calculated by the on board unit (or the server) based on satellite tracking, with the independent vehicle odometer reading.

If the system is not enabled, there will be a consequent mismatch between the car odometer value and the computed value in the system (either within the on board unit or at the server side). Also, since it is not possible to activate the road toll application outside the environment of the car, it is not possible to recover any mismatch that would appear if the user disabled the system on purpose.

The user may be encouraged to use the on board unit in a number of ways, to reduce the temptation to avoid operating the system (apart from the legal consequences if eventually caught):

there may be tax implications which make the use of the system beneficial;

the OBU odometer calculation and actual odometer values can be used to prove the mileage of the car when selling the car secondhand, and indeed this could be made a legal requirement.

Figure 2:
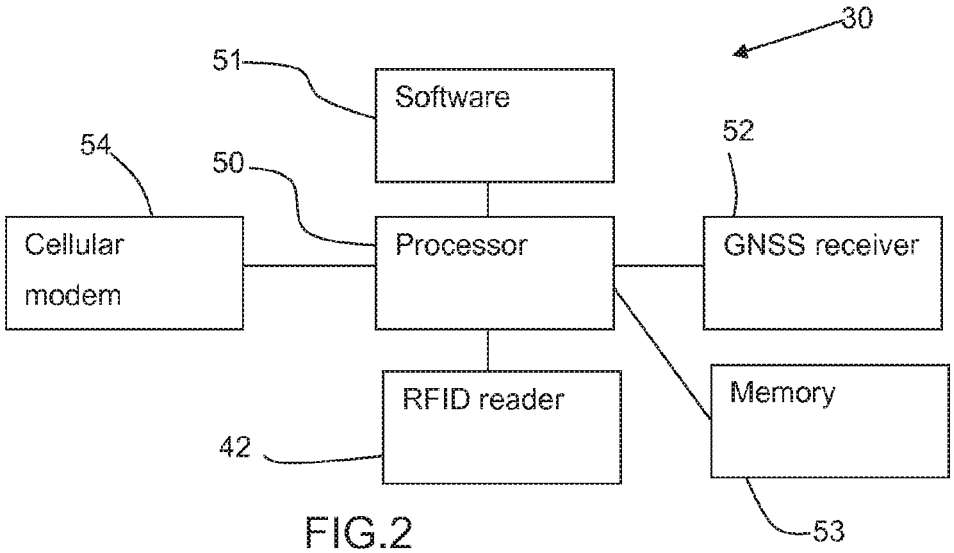
FIG. 2 shows the on board unit of FIG. 1 in greater detail.

FIG. 2 shows in schematic form the units which make up the on board unit 30.

The on board unit comprises a processor 50 which runs software 51 to implement the road tolling application. This processor 50 communicates with the RFID reader 42, the GNSS receiver 52 (for example GPS, GLONASS, or future Galileo receiver), the memory 53 and the cellular modern 54. The cellular modem includes a SIM card (not shown).

Figure 3:
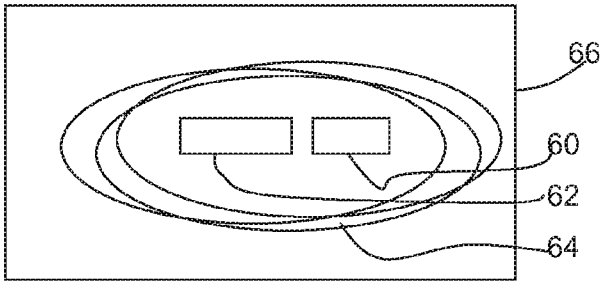
FIG. 3 shows the tag of FIG. 1 in greater detail.

The tag device 40 is shown in greater detail in FIG. 3, and includes an RFID chip 60 including a memory. The tag device may or may not require a battery 62. The device further comprises an antenna 64 in the form of an RFID coil, and the device is adapted to be made dysfunctional by removal or attempted removal from the vehicle.

The device 40 can be an RFID vignette 66 (sticker), which is designed such that attempted removal disconnects the antenna so that the device can no longer be interrogated.

Current road tolling vignettes currently without RFID tags) are being used by for example the Swiss and other road tax vignette systems. These tags cannot be peeled off from the place where they were attached without physical destruction, and the same basic technology can be applied in this case. The idea is to extend the functionality of such a tag with an RFID based function, so that the vignette contains the RFID function and the antenna coil printed on the tag.

When peeled off, the tag is broken and the antenna coil is destroyed. Another implementation can use an RFID chip which includes an input/output port which provides a signal only when rupture is detected. This rupture is detected as a short circuit or open circuit in tracks, and a signal is generated in response to this by a printed circuit battery. The battery capacity is very low (e.g. a capacitor) and is only drained when the rupture event happens, to generate the required signal to provide a signal to memory to indicate the rupture. This memory information can be used to disable the device.

The type of arrangement can be implemented by providing tracks in the vignette. If the vignette is removed, the tracks are short circuited or broken and the event is notified by the integrated chip into the memory.

This system provides a firm link between the satellite tracking system and a specific vehicle by providing a unique identification device for the vehicle, which cannot be removed once attached. This enables the satellite navigation system to be an after-market device, and physically moving the satellite navigation system between vehicles does not need to be prevented.

Thus, binding of the system can be to one vehicle or to a set of vehicles, as will be discussed below, and the remainder of the system does not need to be complicated for this purpose. Thus, the OBU does not require complicated provisions to make removal of the OBU from the vehicle more difficult.

An additional security measure comprises keeping track of the vehicle distance traveled based on the satellite information, so that this can be checked by authorities, such as the police, as part of any routine enquiry.

To enable this, the server is adapted to receive an odometer value for the vehicle when the system is installed or at a reset time. Based on this distance at installation, the system (either the OBU or a remote server) can compute a distance traveled based on the transmitted position or route information, thereby to enable comparison of a new odometer value with an expected odometer value.

This may be combined with the RFID tag to provide multiple levels of anti-tampering security.

The transmitting means of the system can be adapted to transmit an odometer value for the vehicle when the system is installed (or at a subsequent reset time). This provides an automated installation function.

Alternatively, a manual procedure can be followed.

For example, the fitting of an after market system can involve the following steps:

the user purchases the system;

the system has the tamper evident tag discussed above, and this is applied (glued) to the vehicle in a position indicated;

the user then registers the system using a website of the service provider. This can involve providing the following information:

a user identification, which may be linked to official government records, such as passport number and/or driver license number and/or tax reference;

the vehicle license number;

a system ID provided with the system; and the vehicle odometer value.

Following registration, the on-board unit will report back to the server when in close proximity to the tag. When not in close proximity of the tag, the system will not function and a mismatch between the system odometer calculation value and the vehicle odometer value will start to accrue, mentioned above. The features of the system described above provide additional security, ensuring a unit remains associated with a registered vehicle.

As mentioned above, the same OBU can be registered for multiple cars, by providing multiple tags. This enables a single OBU to be used in different vehicles of the same user. Multiple identifications can then be registered by the OBU Each vehicle can still have a unique tag. The system then is operable if one of the registered valid tags is detected. Also, a standard tag can be used, with an encrypted communication set up to tie the tag to the OBU.

As outlined above, the preferred implementation of the system uses an RFID reader within the OBU. This reader can also be used for other purposes, for example to interface with external RFID based service cards, for example public traffic access cards such as the "Translink" system used in the Netherlands. This will allow occasional users, having a Translink public transport card, to hire a car and pay for it automatically. The card then provides a link to the car with the OBU, and the system then can deduct the required value from the service card. Thus, the system can be adapted to deduct immediate payment for the road toll fees, even when a user has not previously been registered, and this can use the RFID reader of the OBU.

As mentioned above, the system of the invention can be used by the user or government to provide proof/authentication of a vehicle odometer reading when the car is sold second hand.

The system of the invention can also be used by service organisations (garages) to register their car service data in the OBU or back end system. When the car is sold, the total history is maintained for the next user and next service organisation.

The preferred example above uses a wireless RFID link. A wired system may also be envisaged (not using RF communication), for example if the OBU receives power from a power cable connected to the vehicle. In this case, the identification chip could also be embedded in the power cable itself, and the power cable be physically attached to the car.

The OBU may be dealer-installed and may have a tamper evident arrangement, if the OBU is for a single car. Alternatively, it may be freely movable between vehicles, for example if the OBU has multiple tags registered for users having more than one vehicle.

An additional level of security may be provided by tuning the sensitivity of the RFID tag and the OBU so that the system is only operable with specific power levels and range of interrogation signals. This can avoid multi-purpose RFID tag readers being able to interrogate the tag.

Another way to provide this type of security is in software, by requiring specific response times to interrogation signals from the RFID reader in the OBU. This can be used to prevent intermediate components being added fraudulently between the OBU and the RFID tag, and/or to prevent relay attacks where the tag signals would be transmitted to a distant OBU, so as to simulate the presence of the tag to the OBU.

The RFID tag can perform additional functions to the identity function. In particular, the RFID tag can have processing power as well as memory capability, and can be used to store and process the system encryption keys used for the secure communication with the server. For example, the RFID tag can include an encryption engine, keys, and a random number generator, so that it is used as a layer of security for all communications with the server.

The system can be implemented as a dual SIM card system, with a GSM SIM card of the user inserted into the OBU, and the tag functioning as a second SIM for communication with the road toll system server.

The detailed implementation of the invention will be routine to those skilled in the art of RFID devices and communication protocols. Various modifications will be apparent to those skilled in the art.

The invention claimed is:

1. A road toll system comprising:

a remote server in communication with a vehicle-mounted unit, wherein the vehicle-mounted unit and a unique identification device are installed within the same vehicle, the remote server comprising a satellite navigation system implementing a position tracking function, the remote server receiving position or route information of the vehicle from the vehicle-mounted unit, wherein the remote server is adapted to receive an odometer value for the vehicle when the system is installed or reset, and wherein the remote server is adapted to compute a distance travelled based on the received position or route information, and compare a new odometer value for the vehicle received from the vehicle-mounted unit with an expected odometer value for the vehicle based on the computed distance traveled, wherein the vehicle-mounted unit will not function if the unique identification device is not present and a mismatch between the expected odometer value and the new odometer value of the vehicle will accrue.

2. The system of claim 1, wherein the remote server disables the road toll function if there is a mismatch between the new odometer value for the vehicle and the expected odometer value for the vehicle based on the computed distance traveled.

3. The system of claim 1, wherein the remote server is adapted to receive an odometer value for the vehicle when the system is installed or reset from the user of the vehicle during a registration process.

4. The system of claim 3, wherein the registration process comprises the user providing:

a user identification;

a vehicle license number;

a system ID; and a vehicle odometer value.

5. The system of claim 1, wherein the road toll system function is enabled only when the unique identification device is present and activation of the vehicle-mounted unit is not possible outside of the vehicle to which the unique identification device is attached, wherein the unique identification device comprises an electronic device which is adapted to alter by detachment or attempted detachment to prevent the road toll system function being enabled.

6. The system of claim 5, wherein the remote server disables the road toll function in response to receiving an alert of damage caused by detachment or attempted detachment of the unique identification device in the vehicle-mounted unit.

7. The system of claim 1, wherein the vehicle-mounted unit further comprises a reader to detect the unique identification device, wherein the vehicle-mounted unit requires specific response times to interrogation signals from the reader.

8. The system of claim 1, wherein the unique identification device comprises an RFID sticker which is interrogated by the system in use.

9. The system of claim 1, wherein the unique identification device comprises a chip embedded in a power cable, the power cable being attached to the vehicle, and communication with the unique identification device being made through the cable.

10. The system of claim 1, wherein the remote server is configured to determine routes taken by the vehicle based on the received position information.

11. The system of claim 1, wherein the remote server uses a database of road prices valid at a certain time to compute a total price for the vehicle.

12. A method of operating in a road toll system comprising:

at a server remote from a vehicle-mounted unit, wherein the vehicle-mounted unit is installed within the same vehicle as a unique identification device:

implementing a position tracking function using a satellite navigation system;

receiving position or route information from the vehicle-mounted unit;

receiving an odometer value for the vehicle when the system is installed or reset;

computing a distance travelled based on the receiver position or route information; and comparing a new odometer value for the vehicle received from the vehicle-mounted unit with an expected odometer value for the vehicle based on the computed distance traveled;

wherein the vehicle-mounted unit will not function if the unique identification device is not present and a mismatch between the expected odometer value and the new odometer value of the vehicle will accrue.

13. The method of claim 12 comprising, at the remote server, disabling the road toll function if there is a mismatch between the new odometer value for the vehicle and the expected odometer value for the vehicle based on the computed distance traveled.

14. The method of claim 12 comprising, at the remote server, receiving the odometer value for the vehicle when the system is installed or reset from the user of the vehicle during a registration process.

15. The method of claim 14 comprising, at the remote server, performing the registration process based on the user providing:

a user identification;

a vehicle license number;

a system ID; and a vehicle odometer value.

16. The method of claim 12 comprising, at the remote server, disabling the road toll function in response to receiving an alert of damage caused by detachment or attempted detachment of the unique identification device in the vehicle-mounted unit.

17. The method of claim 12 comprising, at the remote server, determining routes taken by the vehicle based on the received position information.

18. The method of claim 12 comprising, at the remote server, using a database of road prices valid at a certain time to compute a total price for the vehicle.

19. The method of claim 1, wherein the remote server is adapted to compute the distance travelled based on the received position or route information and the odometer value received when the system is installed or reset.

* * * * *